US009885156B2

(12) United States Patent
Malmquist

(10) Patent No.: US 9,885,156 B2
(45) Date of Patent: Feb. 6, 2018

(54) PICK MAT LOCKING SYSTEM

(71) Applicant: M. Casey Malmquist, Whitefish, MT (US)

(72) Inventor: M. Casey Malmquist, Whitefish, MT (US)

( * ) Notice: Subject to any disclaimer, the term of this patent is extended or adjusted under 35 U.S.C. 154(b) by 0 days.

(21) Appl. No.: 14/993,053

(22) Filed: Jan. 11, 2016

(65) Prior Publication Data

US 2016/0312413 A1 Oct. 27, 2016

Related U.S. Application Data

(60) Provisional application No. 62/101,392, filed on Jan. 9, 2015, provisional application No. 62/200,619, filed on Aug. 3, 2015.

(51) Int. Cl.

| | |
|---|---|
| ***E01C 9/08*** | (2006.01) |
| ***E01C 5/00*** | (2006.01) |
| ***E01C 5/14*** | (2006.01) |

(52) U.S. Cl.

CPC ..... *E01C 9/086* (2013.01); *E01C 5/00* (2013.01); *E01C 5/003* (2013.01); *E01C 5/14* (2013.01)

(58) Field of Classification Search

CPC ... E01C 5/00; E01C 5/003; E01C 5/14; E01C 5/005; E01C 9/086

See application file for complete search history.

(56) References Cited

U.S. PATENT DOCUMENTS

| | | | | | |
|---|---|---|---|---|---|
| 2,019,692 | A * | 11/1935 | Mueller | E04F 15/04 | 160/229.1 |
| 2,834,065 | A * | 5/1958 | Mueller | E04F 15/04 | 108/13 |
| 4,577,448 | A * | 3/1986 | Howorth | E01C 5/005 | 403/408.1 |
| 4,604,962 | A * | 8/1986 | Guibault | B63B 35/38 | 114/218 |
| 6,662,508 | B1 * | 12/2003 | Else | A63C 19/12 | 404/40 |
| 7,303,800 | B2 * | 12/2007 | Rogers | B32B 3/02 | 404/34 |
| 7,608,313 | B2 * | 10/2009 | Solomon | E04B 1/6141 | 404/35 |
| 7,980,040 | B2 * | 7/2011 | Pacione | A47G 27/0468 | 52/584.1 |
| D656,250 | S * | 3/2012 | Forster | D25/153 | |
| 8,424,257 | B2 * | 4/2013 | Jenkins | E01C 5/20 | 52/177 |
| 8,881,482 | B2 * | 11/2014 | Cerny | E04F 15/02038 | 52/126.5 |
| 9,051,739 | B2 * | 6/2015 | Rosan | E01C 9/086 | |

(Continued)

*Primary Examiner* — Abigail A Risic
(74) *Attorney, Agent, or Firm* — Law Office of Craig Bohn; Craig E. Bohn

(57) ABSTRACT

A pick mat connection system (10, 40) that enables components to be connectable horizontally, to adapt to varied work site sizes, or vertically, to adapt to varied weight demands. Employing anchor assemblies (10), comprising an anchor (12) and lock (14) structure, to permit multiple standardized mats (1) to be connected horizontally, both end to end, and side to side. Additionally, employing stack anchor assemblies (40), selectively vertically connectable by a lock or bolt assembly (50), which enables the layering of multiple mats (7), thereby increasing the effective mat thickness.

8 Claims, 7 Drawing Sheets

(56) References Cited

U.S. PATENT DOCUMENTS

| | | | | |
|---|---|---|---|---|
| 9,133,628 | B2 * | 9/2015 | Moller, Jr. | E04F 15/225 |
| 9,249,570 | B2 * | 2/2016 | Jean | E04B 5/023 |
| 9,506,255 | B1 * | 11/2016 | Jones | E01C 9/086 |
| 2002/0078652 | A1 * | 6/2002 | Hawkes | E01C 5/005 52/578 |
| 2003/0136074 | A1 * | 7/2003 | Ku | E04F 15/02 52/591.3 |
| 2005/0072094 | A1 * | 4/2005 | Ardern | E01C 5/005 52/574 |
| 2007/0223993 | A1 * | 9/2007 | Peterson, Jr. | E01C 5/005 403/364 |
| 2008/0072514 | A1 * | 3/2008 | Barlow | A63B 69/3661 52/540 |
| 2013/0167458 | A1 * | 7/2013 | Cerny | E04F 15/02038 52/177 |
| 2014/0150367 | A1 * | 6/2014 | Chojnowski | E04F 15/02044 52/582.1 |
| 2014/0199119 | A1 * | 7/2014 | Stasiewich | E01C 9/08 404/41 |
| 2014/0270945 | A1 * | 9/2014 | Bach | E01C 5/20 404/36 |
| 2015/0098757 | A1 * | 4/2015 | Mitchell | E01C 5/005 404/40 |

* cited by examiner

PICK MAT LOCKING SYSTEM

CROSS-REFERENCE TO RELATED APPLICATIONS

This application claims the benefit of U.S. Provisional Application Ser. No. 62/101,392, filed on Jan. 9, 2015, by the present inventor, entitled "Pick Mat Horizontal and Stackable Locking System," and U.S. Provisional Application Ser. No. 62/200,619, filed on Aug. 3, 2015, by the present inventor, entitled "Cross Laminated Timber Construction Systems," which applications are both hereby incorporated by reference in its entirety for all allowable purposes, including the incorporation and preservation of any and all rights to patentable subject matter of the inventor, such as features, elements, processes and process steps, and improvements that may supplement or relate to the subject matter described herein.

BACKGROUND OF THE INVENTION

Field of the Invention

Embodiments of the present disclosure generally relate to systems for creating a non-permanent stable work platform.

Description of the Related Art

Pick mats are known in the industry for use in creating non-permanent work platforms, typically in remote locations. Such non-permanent work platforms are essential for numerous types of ventures, including timber and mining operations, as examples. Much time and effort goes into assembling mats on locations, and configuring multiple mats into functional, stable platforms. The field is challenged by establishing work platforms of varied sizes and capacities, problems that are typically dealt with by making mats of larger or thicker sizes. However, larger mats are more difficult to transport and position at the intended use location. Additionally, platforms of varied thicknesses are needed to address the load to be borne by the work platform at the work location. Heavier equipment currently requires mats of greater thickness. Again these mats are more difficult to transport and position at the intended use location. It would be an improvement to the art to have a method of connecting more uniformly sized mats both horizontally and in a stacked orientation, in order to be able to adapt the platform to the specific use requirement, either in total area or in thickness, in order to support greater weight.

SUMMARY OF THE INVENTION

Embodiments described herein generally relate to a system for standardizing pick mat components that are connectable horizontally, to adapt to varied work site sizes, or vertically, to adapt to varied weight demands. The current system employs anchor assemblies, comprising a lock and key structure, to permit multiple standardized mats to be connected horizontally, both end to end, and side to side. Additionally, the current system employees stack anchor assemblies, selectively vertically connectable by a bolt assembly, which enables the layering of multiple mats, thereby increasing the effective mat thickness. This combination of anchor assemblies enables one to construct a platform adapted to the specific use requirement, either in total area or in thickness, in order to support greater weight.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein generally relate to a system for standardizing pick mat components that are connectable horizontally, to adapt to varied work site sizes, or vertically, to adapt to varied weight demands. The pick mats used in the exemplary embodiment are wooden 3 ply, 8 foot by 20 foot rig mats, but mats of other specifications may be suitable for uses.

In an exemplary embodiment, a system employees anchor assemblies, comprising a lock and key structure, to permit multiple standardized mats to be connected horizontally. Connection can be made both end to end, and side to side, to create the work area required for a particular need.

In another exemplary embodiment, a system employs stack anchor assemblies, selectively vertically connectable by a bolt assembly. Layers of horizontal mat assemblies are stacked, and the stack anchor assemblies enable functionally rigid connection between the layers. The pick mats used in the exemplary embodiment are wooden 7 ply, 8 foot by 40 foot rig mats, but mats of other specifications may be suitable for uses.

Figure 1:
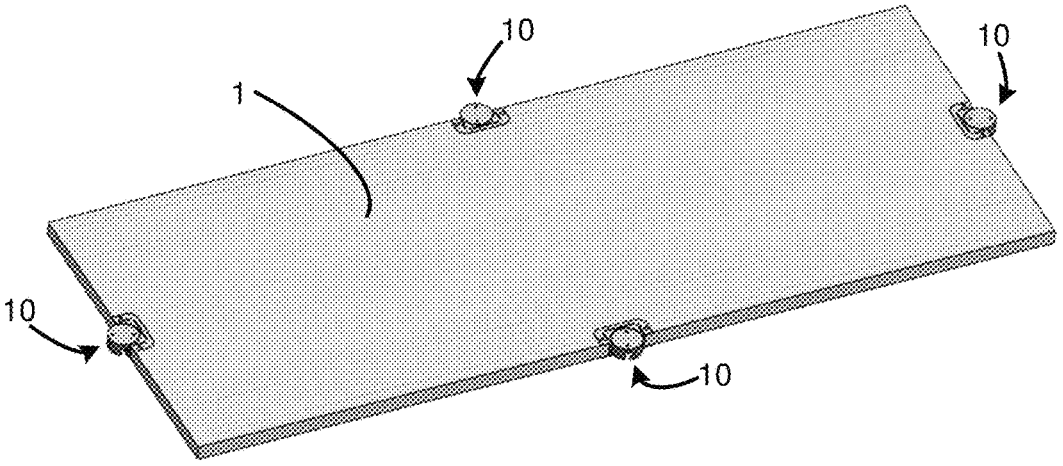
FIG. 1 is a perspective view illustration of an exemplary pick mat according to embodiments described herein.
Figure 2:
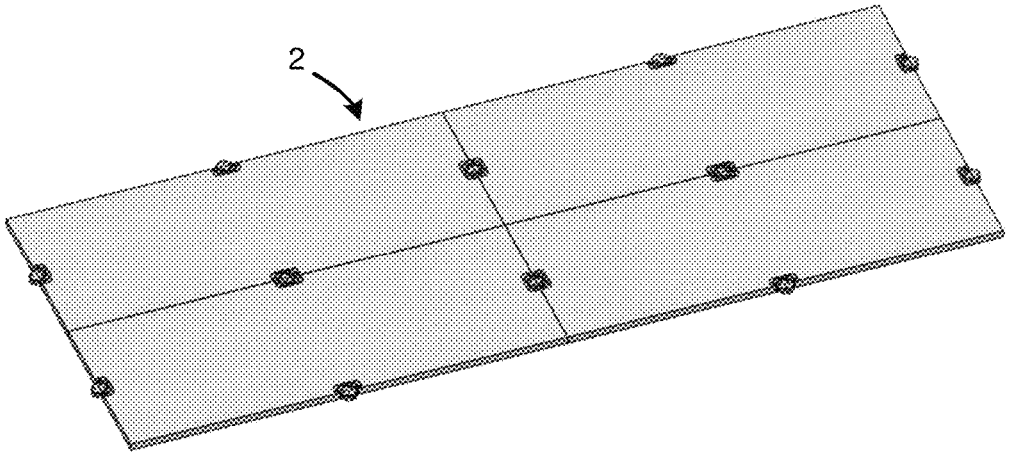
FIG. 2 is a perspective view illustration of an exemplary pick mat assembly according to embodiments described herein.
Figure 3:
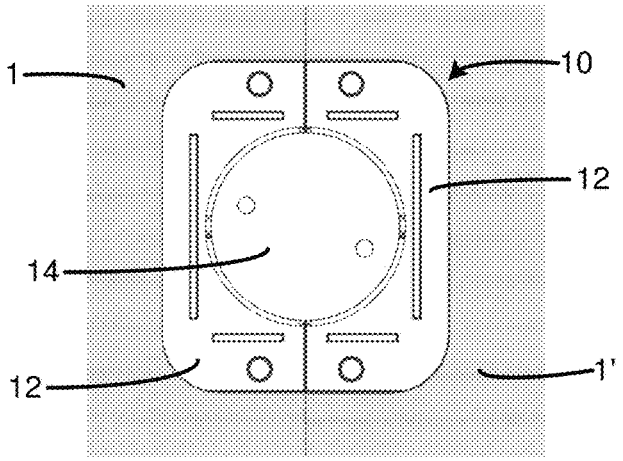
FIG. 3 is a normal top view illustration of an anchor assembly according to embodiments described herein.
Figure 4:
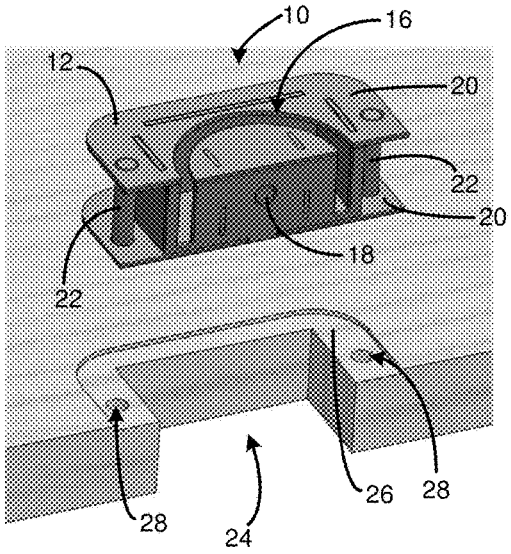
FIGS. 4 and 5 are perspective view illustrations of an anchor assembly according to embodiments described herein.
Figure 5:
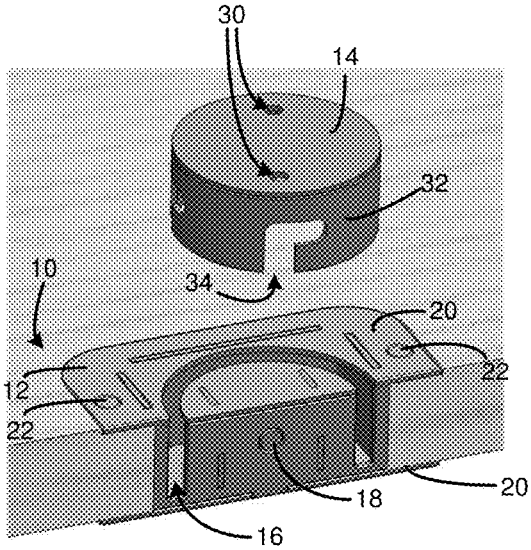
Figure 6:
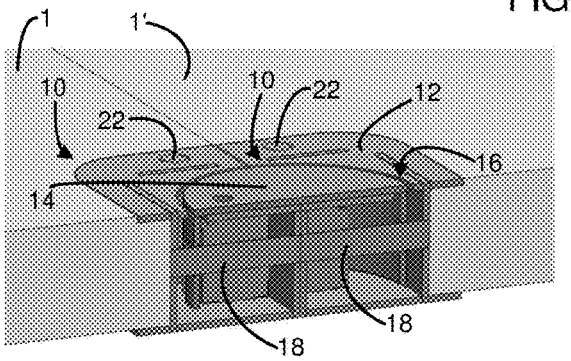
FIG. 6 is a vertically bisected perspective view illustration of an anchor assembly according to embodiments described herein.
Figure 7:
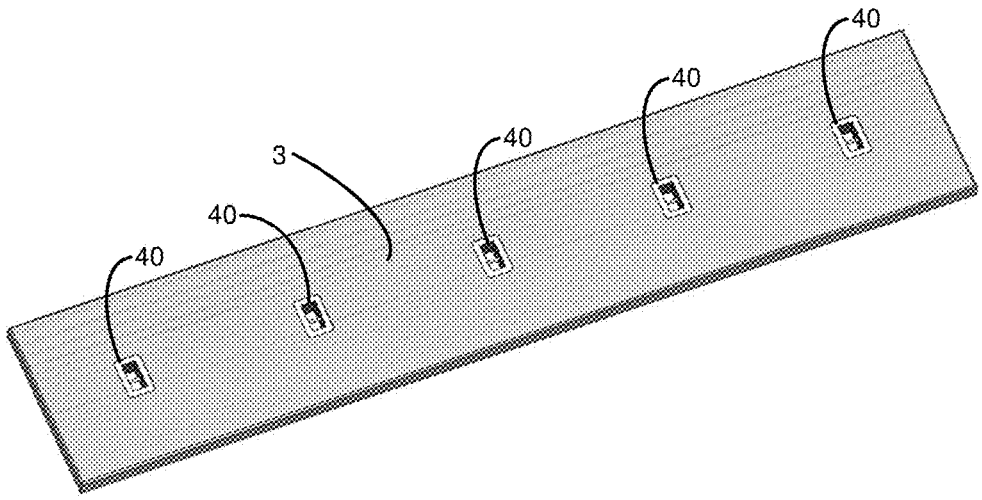
FIG. 7 is a perspective view illustration of an exemplary stackable pick mat according to embodiments described herein.
Figure 8:
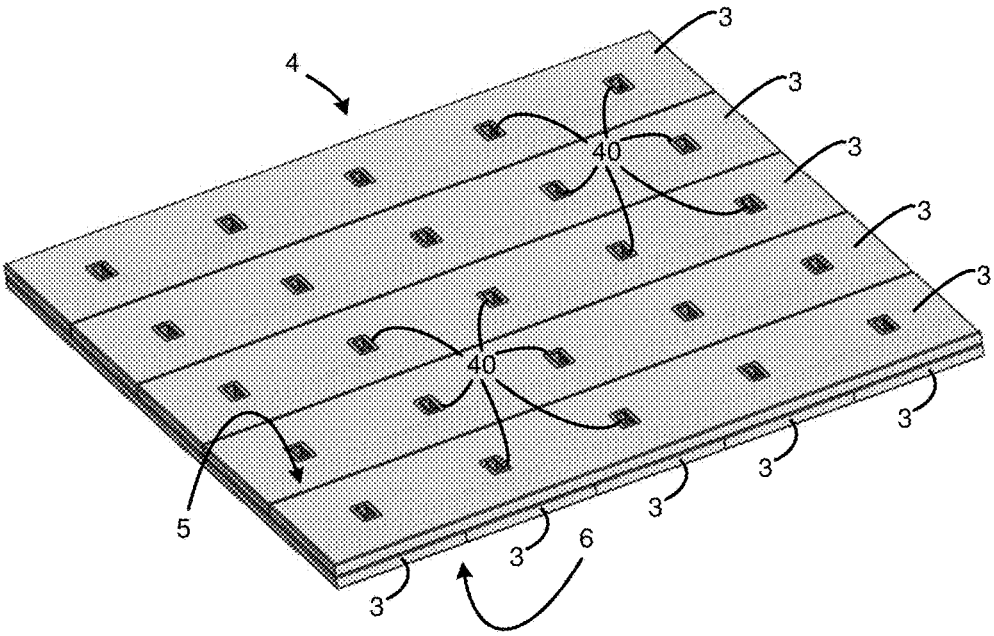
FIG. 8 is a perspective view illustration of an exemplary stackable pick mat assembly according to embodiments described herein.
Figure 9:
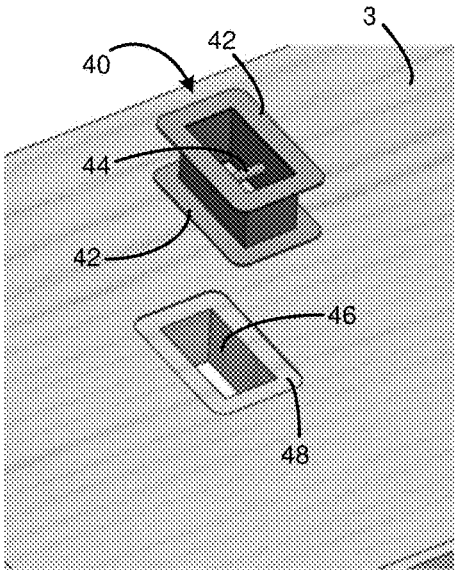
FIGS. 9 and 10 are perspective view illustrations of an exemplary stack anchor assembly according to embodiments described herein.

Referring now to FIGS. 1 through 6, an exemplary modular assembly system is shown to comprise multiple mats 1 configurable into variable mat assemblies 2. Multiple anchor assemblies 10 are selectively positionable along the outward edges of the individual mat 1 components. An exemplary anchor assembly 10 is shown to comprise an anchor 12 and a lock 14. A particular mat 1 may house multiple anchors 12 along its outer edge. A pick mat connection system that may create variable mat assemblies 2 may be described having an anchor assembly, as shown in FIG. 3, intermediate two pick mats 1, where the anchor assembly may have two anchors 12 and a lock 14. The pick mats may be seen as pick mat assemblies, since they may be constructed of cross laminated timber, may have multiple types of anchor systems, and may have other features making them suitable for use a pick mats. Each of the two pick mat 1 assemblies may be fixedly attached to a distinct one of the two anchors 12, and the lock 14 selectively removably engageable with the two anchors 12. The variable mat assemblies 2 may be described as configured side-by-side or edge-to-edge.

In the exemplary embodiment, anchor 12 possesses a lock rod 18 positioned horizontally within a lock recess 16. An anchor 12 may be attached to a mat 1 at a point where an anchor notch 24 is formed. Additionally, the exemplary embodiment has an anchor shoulder recess 26 around the anchor notch and a pair of anchor pin holes 28 formed in the mat 1. The exemplary anchor 12 has an anchor shoulder 20 that is positionable within the anchor shoulder recess 26 so that the anchor 12 does not protrude out from the surface of mat 1. Additionally, the exemplary body meant as to anchor pin holes 28 to receive the corresponding anchor pin 22, and secure the anchor 12 to the mat 1 within the anchor notch 24.

Mats 1 may be connected to one another by positioning an anchor 12 from one mat 1 against an anchor 12 of another mat 1. A lock 14 is then inserted into lock recesses 16 of the adjoining anchors 12. The lock 14 may then be rotated slightly to secure and the pair of lock recesses 16. To facilitate the rotation of lock 14, exemplary lock 14 has a pair of key recesses 30. A suitable key (depicted in FIGS. 23 and 24, and the supplemental drawings, and described later) may engage the key recesses 30 to provide rotational leverage.

The exemplary lock 14 comprises a lock wall 32 that forms a cylindrical structure. A lock rod recess 16 is formed in the lock wall 32. The exemplary lock rod recess 34 is suitably sized to engage lock rod 18. Lock rod recess 34 extends upwardly a distance into the lock wall 32, then curves at a right angle to extend a short distance around the circumference of the lock wall 32. The size of the lock rod 18, depth of the lock rod recess 34, the distance the lock rod recess 34 extends around the circumference of the lock wall 32 are chosen to suitably withstand the structural demands that may be placed on the anchor assembly 10.

In addition to its function in the anchor assembly 10, lock rod 18 may be used as a suitable connection point for a lifting hook and cable, commonly referred to as a pick rod. The lock recess 16 may also be sized to permit the insertion of a standard cable into the recess, so as to be used to lift the mat 1. The existence of a pick rod on the mat 1 permits the lifting and manipulation of the mat 1 with equipment typically available at a deployment site.

Referring now to FIGS. 7 through 13, an exemplary modular assembly system is shown to comprise multiple stackable mats 3 configurable into variable stacked mat assembly 4. In this type configuration the large surfaces of multiple mats 3 may be connected together to form a stronger assembly. In the exemplary embodiment, a mat layer 5 of mats 3 are laid on top of a mat layer 6 of mats 3. The mats 3 of mat layer 5 lay perpendicular to the mats 3 of mat layer 6, providing greater strength and durability to the stacked mat assembly 4. This configuration may provide suitable stability for some applications.

For greater stability, the mats 3 of mat layer 5 may be anchored to the mats 3 of mat layer 6. To facilitate connection, each exemplary mat 3 has a plurality of stack anchors 40 positioned a coordinated distance apart down the centerline of the length of the mat 3. The exemplary stack anchor 40 is constructed out of steel and has a rectangular cylindrical shape. Each stack anchor 40 has at least one stack anchor shoulder 42 to abut against the surface of the mat 3. Additionally, a pick rod 44 is positioned laterally across the opening of the stack anchor 40. Stack anchor 40 is seated in a stack anchor recess 46 in a mat 3. The exemplary embodiment also has a stack anchor shoulder recess 48 to permit the stack anchor shoulder 42 to lay flush with the surface of mat 3.

The mat layers 5 and 6 may be anchored together by aligning stack anchors 40 in mat layer 5 with stack anchors 40 in mat layer 6. A bolt assembly 50 is then used to connect the aligned stack anchors 40 in mat layer 5 to the corresponding stack anchors 40 in mat layer 6. The exemplary bolt assembly 50 consists of a bolt shaft 52 having a bolt hook 58 at one end and threads at the other end to receive a nut 54. A slide hook 56 may be slid onto the bolt shaft 52 prior to spreading the not onto the bolt shaft 52. With a first stack anchor **40*a* aligned above a second stack anchor 40*b*, the bolt assembly 50 may be connected between by engaging the pick rod 44*a* of stack anchor 40*a* with the slide hook 56, while at the same time engaging the pick rod 44*b* of stack anchor 40*b* with the bolt hook 58. Nut 54 is then tightened against slide hook 56 to draw slide hook 56 closer to bolt hook 58, securing the two stack anchors 40 to each other. This configuration may be described as selectively secured surface-to-surface connections of multiple pick mats 3**.

Figure 10:
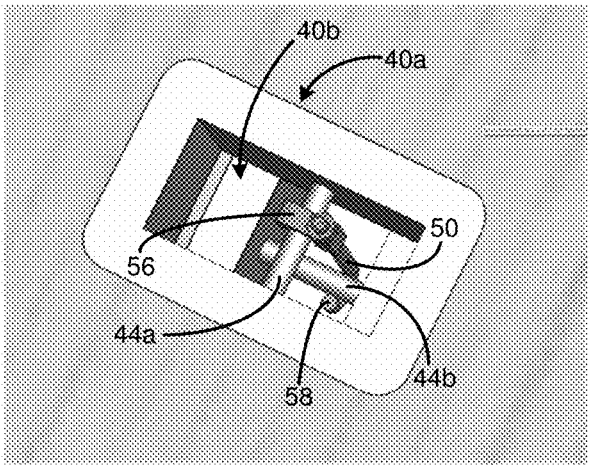
Figure 11:
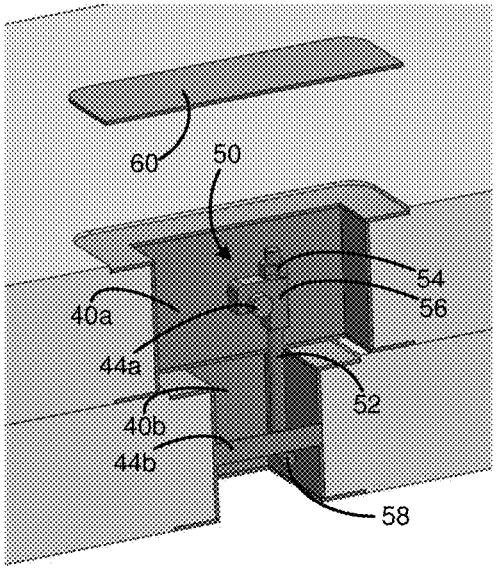
FIGS. 11 and 12 are vertically bisected perspective view illustrations of a stack anchor assembly according to embodiments described herein.
Figure 12:
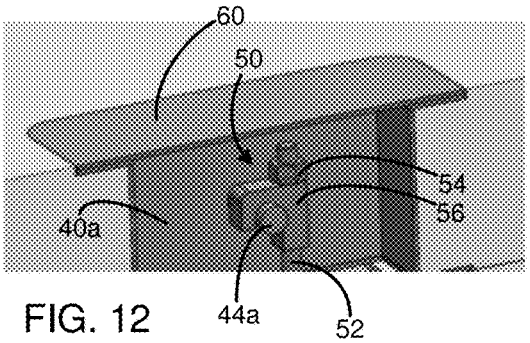

A pick mat connection system that may create variable mat assemblies 4 may be described having an anchor assembly, as shown in FIGS. 10 through 12, intermediate two pick mats 3, where the anchor assembly may have two anchors 40 and a lock 50. The pick mats 3 may be seen as pick mat assemblies, since they may be constructed of cross laminated timber, may have multiple types of anchor systems, and may have other features making them suitable for use a pick mats. Each of two pick mat 3 assemblies may be fixedly attached to a distinct one of the two anchors 40, and the lock 50 selectively removably engageable with the two anchors 40. The variable stacked mat assemblies 4 may be described as configured surface-to-surface, face-to-face, or stacked.

A cover 60, of corresponding size to the stack anchor shoulder 42, may then be placed over the stack anchor 40, in the stack anchor shoulder recess 48, to prevent debris from filling the center of the stack anchor 40.

In addition to its function in the stack anchor 40, a pick rod 44 may be used as a suitable connection point for a lifting hook and cable (not shown). The existence of a pick rod 44 on the mat 3 permits the lifting and manipulation of the mat 3 with equipment typically available at a deployment site. In the exemplary embodiment, the stack anchors 40 are spaced 8 feet apart on a forty foot mat, but other distributions may be suitable for particular uses.

Figure 13:
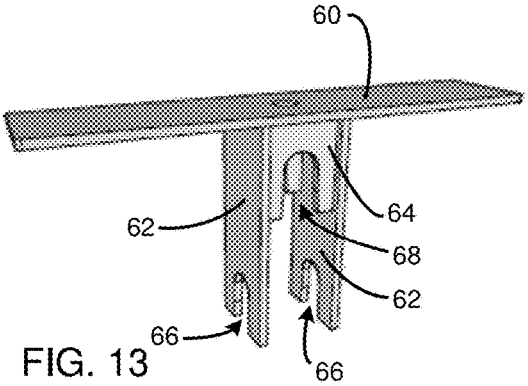
FIG. 13 is a perspective view illustration of an alternate exemplary cover for a stack anchor assembly according to embodiments described herein.
Figure 14:
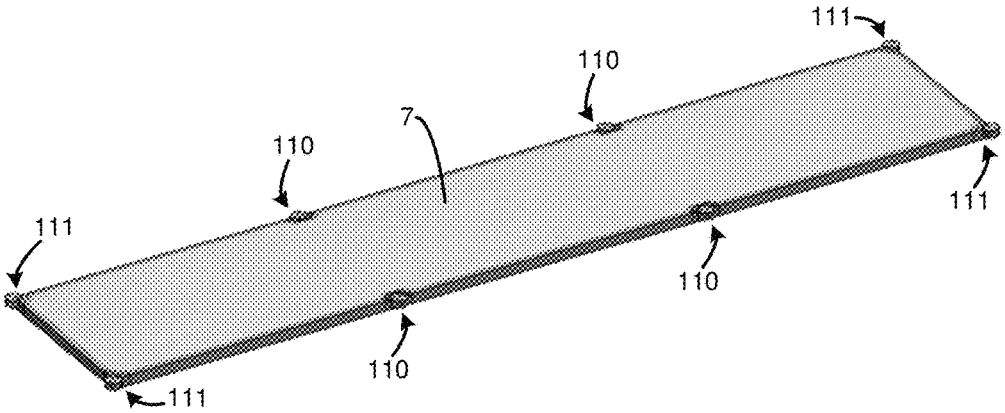
FIG. 14 is a perspective view illustration of an exemplary steel railed pick mat according to embodiments described herein.
Figure 15:
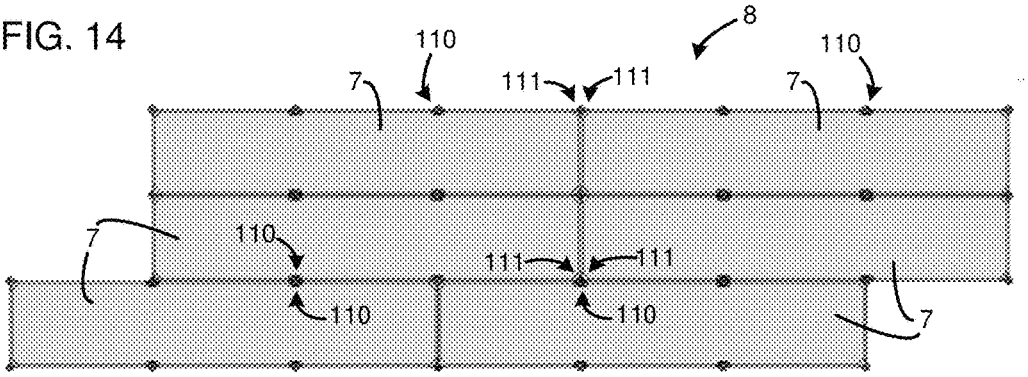
FIG. 15 is a normal top view illustration of an exemplary steel railed pick mat assembly according to embodiments described herein.

Focusing on FIG. 13, an alternate exemplary embodiment of a cover 60 may include alignment projections such as lower layer alignment projections 62 and upper layer alignment projections 64. In the exemplary embodiment, lower layer alignment projections 62 has a distal notch 66 to accommodate the pick rod 44*b* of stack anchor 40*b*. In the exemplary embodiment, upper layer alignment projections 64 has a distal notch 68 to accommodate the pick rod 44*a* of stack anchor 40*a*.

Referring now to FIGS. 14 through 22, an exemplary modular assembly system is shown to comprise multiple steel railed mats 7 configurable into variable staggerable mat assemblies 8. Multiple anchor assemblies 110 are selectively positionable along the outward edges of the individual mat 7 components. An exemplary anchor assembly 110 is shown to comprise an anchor 112 and a lock 114, or an alternate lock 115. A particular mat 7 may house multiple anchors 112 along its outer edge. Additionally, with the added strength of the steel rail, the exemplary embodiment may also have corner anchor assemblies 111. The addition of corner anchor assemblies 111 enables more variety in the staggerable mat assembly 8. A combination anchor assembly 113 may be configured by combining a side anchor assembly 110 and two corner anchor assembly 111. This configuration permits a greater variety of staggering mat assemblies 8 that are creatable with a plurality of the same standard mats 7. It also enables the ability to work around fixed elements at a deployment site, such as trees, utility installations, or building structures.

Figure 16:
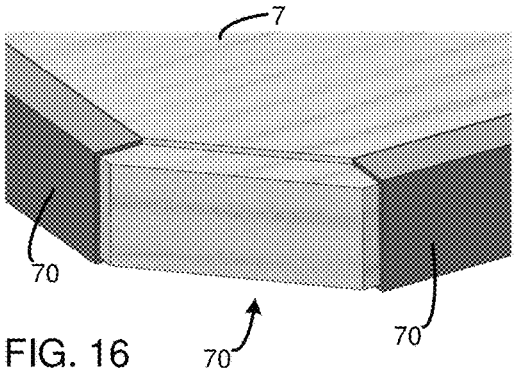
FIG. 16 is a perspective view illustration of an exemplary steel railed mat adaptable to receive a corner anchor assembly according to embodiments described herein.
Figure 17:
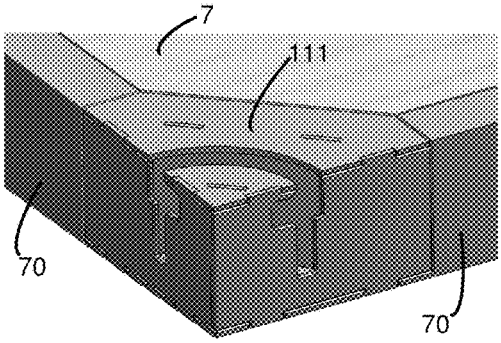
FIG. 17 is a perspective view illustration of an exemplary steel railed mat adapted with a corner anchor assembly according to embodiments described herein.
Figure 18:
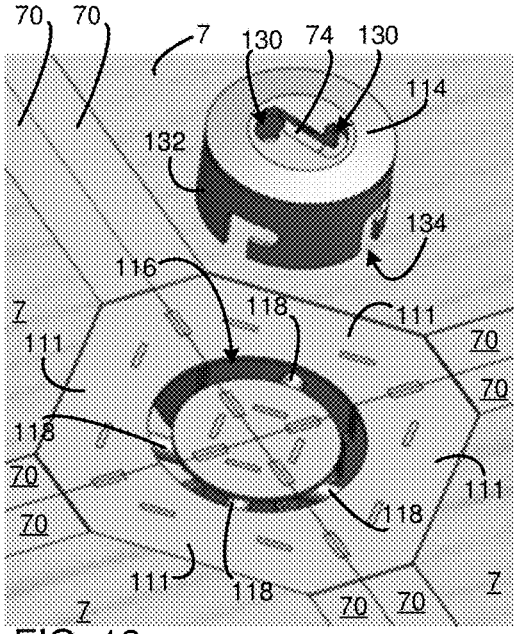
FIGS. 18 and 19 are perspective view illustrations of an anchor assembly for steel railed mats according to embodiments described herein.

Referring to FIG. 16, a typical steel railed mat may be modified to accommodate a corner anchor assembly 111 by removing the corner section of the rails 70 and angling the mat to create a prep corner 72. The corner anchor assembly 111 may then be welded into place against the cut ends of adjacent rails 70. So modified, the mat becomes a steel rail mat 7, as anticipated by the current embodiments.

Referencing again FIGS. 14 through 22, the exemplary embodiments envisioned the connection of two side anchor assemblies 110, four corner anchor assemblies 111, or the creation of a combination anchor assembly 113 by connecting a single side anchor assembly 110 with up to two corner anchor assemblies 111. All three of these exemplary embodiments employ a cylindrical lock 114, open on an insertion side, and closed on the opposite side where a key recess is located, to hold the anchor assemblies 110, 111, or 113 together. The insertion side of the lock 114 is inserted into the coordinated key recesses 116 of the various anchor assemblies 110, 111, or 113. The cylindrical lock wall 132 is suitably sized to fit the key recesses 116. Additionally, the lock wall 132 comprises a lock rod recess 134 suitably sized and positioned to receive the lock rods 118 that transverse the key recesses 116. The lock rod recesses 134 are shaped so as to permit the lock 114 to slide over the combination of lock rods 118 a suitable distance. The lock 114 may then be slightly rotated to impinge against the lock rods 118, preventing the lock 114 from being withdrawn from the collective key recesses 116. The distances envisioned in lock recesses 134 and thickness of lock wall 132 are suitable designed to provide the structural support required for the intended operations. Additional alternate lock 115 is suitable as a replacement for alternate lock 114. They differ in construction, where one may be milled and the other is made from cut and welded parts.

Figure 19:
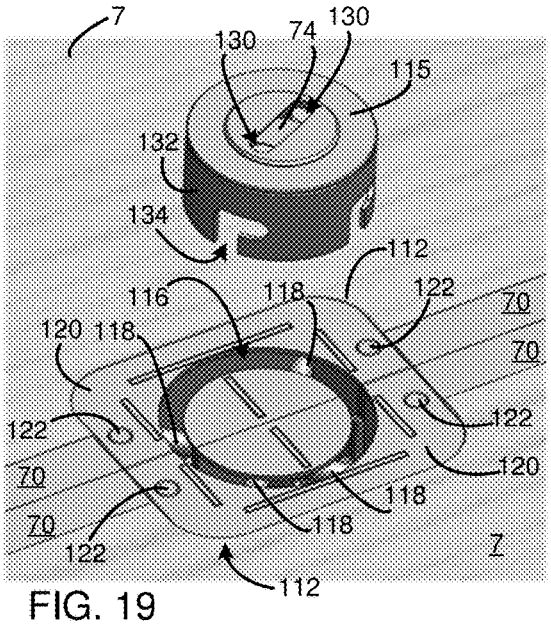
Figure 20:
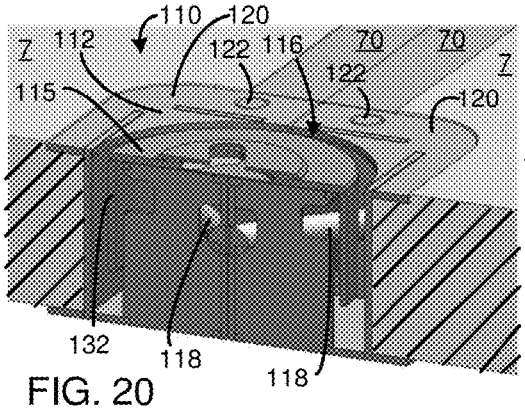
FIG. 20 a vertically bisected perspective view illustration of an anchor assembly for steel railed mats according to embodiments described herein.
Figure 21:
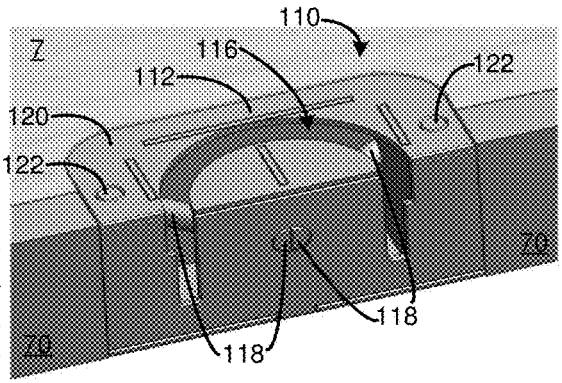
FIG. 21 is a perspective view illustration of a lock for steel railed mats according to embodiments described herein.
Figure 22:
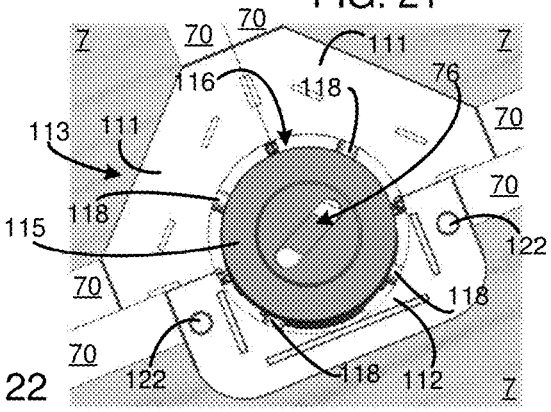
FIG. 22 is a normal top view illustration of an exemplary combination anchor assembly for steel railed mats according to embodiments described herein.
Figure 23:
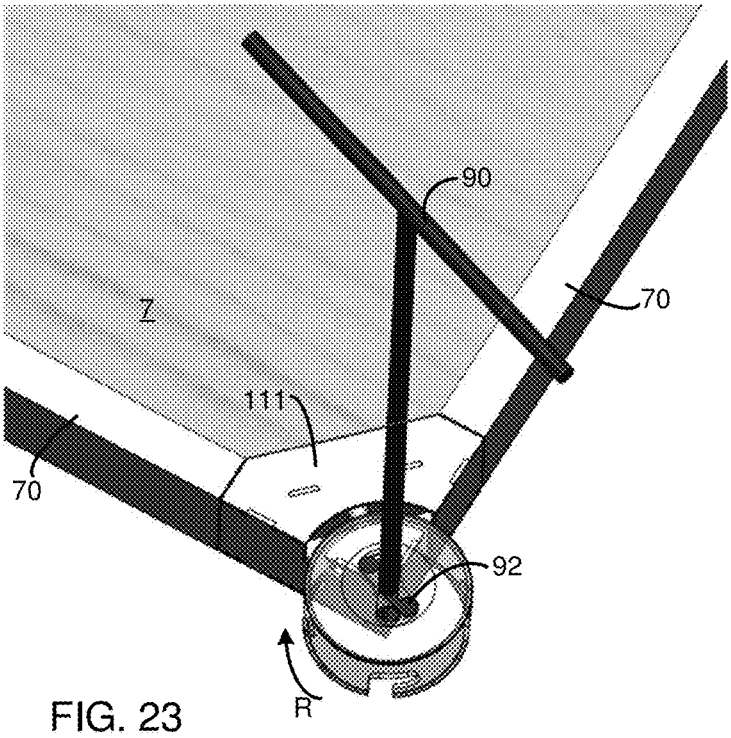
FIGS. 23 and 24 are perspective view illustrations of an exemplary lock key according to embodiments described herein.
Figure 24:
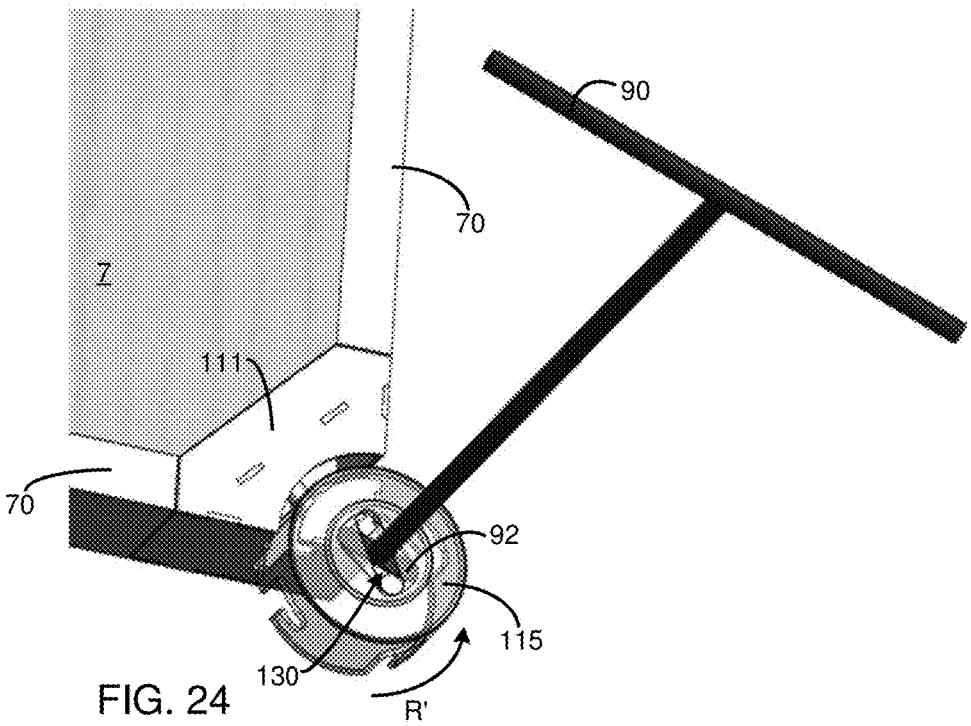

Referring now to FIGS. 19, 23 and 24, a key 90 for alternate lock 115 is shown, along with an illustration of the insertion, extraction, and rotational operation of the exemplary lock 115. Exemplary key 90 has a cross-piece perpendicular to the key shaft that has a pair of key prongs 92 extending outwardly, away from the key handle. The exemplary cross-piece and key prongs 92 are correspondingly sized and shaped to engage in the key recess 76, and the key prongs recess 130. When suitably engaged, the lock 115 will impinge on the cross-piece and be removably connected to the key 90, permitting a user to position the lock 115 into the lock recesses 116 using the key 90. The key 90 is then used to slightly rotate the lock to engage the lock rods 118, in the direction of the rotation arrow R. After such selective engagement the key 90 may be rotated to disengage the cross-piece and key prongs from the lock 115 without displacing the lock from the anchor 111.

To remove the exemplary lock 115 from the anchor 111 the key prongs 92 are inserted into the key prong recesses 130, seating the cross-piece in the key recess 76. The key 90 may then be rotated slightly in the direction of the rotation arrow R' to back the lock rods 118 out of the lock rod recesses 134. With the key prongs 92 removably seated in the key prong recesses 130, the key 90 may be used to pull the lock 115 out of the coordinated lock recesses 116.

An example patent claim that could be made to the exemplary embodiment could be: A mat connection system comprising an anchor assembly intermediate two mats, the anchor assembly having two anchors and a lock, each mat fixedly attached to a distinct one of the two anchors, and the lock selectively removably engageable with the two anchors. An additional limitation may include each anchor having a lock rod, and the lock coordinatedly engaging both lock rods.

Alternate manner to claim the subject matter of this disclosure may include a pick mat connection system, comprising at least two mat anchors each which may be connectable to a pick mat, and the mat anchors each may have a pick point. A lock shaped to engage the pick points of the mat anchors may also be included; and the mat anchors may have a connected position and a disconnected position, where the mat anchors removably engaged with the lock in the connected position, and the mat anchors disengaged from the lock in the disconnected position.

Additionally, claims could include that a first pick mat may be connected to one of the mat anchors, and a second pick mat may be connected to the other mat anchor. At least one pick mat may comprise cross laminated timber. The pick point of the mat anchors may be removably engaged with the lock, which may be intermediate the pick mats in the connected position. Further, the mat anchors may be connected to their respective pick mat along an edge of their respective pick mat, and a first side-by-side pick mat assembly may have the mat anchors in the connected position, with the respective pick mats oriented side-by-side, as in FIG. 2.

In an exemplary embodiment, claims could include that each mat anchor may have a flat mat surface, and a pick point within a lock recess. The lock recess may have a cylindrical groove shape with an axis perpendicular to the mat anchor flat mat surface. The pick point may traverse the lock recess parallel to the mat anchor flat mat surface. The lock may have a cylindrical lock wall, corresponding in size to the lock recess, with a latch recess shaped to first linearly and then rotationally engage the pick point within the lock recess. An exemplary embodiment of configuration is shown in FIGS. 4 through 6, and 14 through 24

Alternatively, claims could include that the mat anchors may be connected to their respective pick mat within the interior of the pick mats, and a first face-to-face pick mat assembly may have the mat anchors in the connected position, with the respective pick mats oriented face-to-face. Alternatively, claims could include that the mat anchors may be connected to their respective pick mat along the midline of the pick mats, and that a first face-to-face pick mat assembly may have the mat anchors in the connected position, with the respective pick mats oriented face-to-face. Exemplary embodiments of configurations are shown in FIGS. 7 through 12.

In an exemplary embodiment a layered mat platform may be constructed. Claims could include the first side-by-side pick mat assembly and a second side-by-side pick mat assembly each may have a flat side spanning the pick mats. The flat side of the first side-by-side pick mat may be positioned on top of the flat side of the second side-by-side pick mat assembly. The first side-by-side pick mat assembly may have the pick mats running widthwise of the second side-by-side pick mat assembly, and each side-by-side pick mat assembly may have a stacked mat anchor connected to one of the pick mats along the midline of the pick mat. Each stacked mat anchor may have a stacked pick point, and a stacked lock lockably engageable with the stacked pick points of the stacked mat anchors. The stacked mat anchors may have a connected stacked position and a disconnected stacked position, where the stacked pick point of the stacked mat anchors may be removably engaged with the stacked lock intermediate the stacked pick mats in the connected stacked position and the stacked pick point of the stacked mat anchors disengaged with the stacked lock in the disconnected stacked position.

Additionally, the claims may include that the stacked lock may have a bolt and two engagement ends, and at least one engagement end may be adjustable in distance from the other engagement end. Additionally, one engagement end may be a J-shaped ending formed in the bolt. Additionally, one engagement end may be a hook slideable along a length of the bolt, and secureable to the bold by a nut.

An additional limitation may include an additional two mats, each pair of mats connected in pairs side-by-side, and one pair of mats on top of the other with the length of one pair of mats running widthwise of the other pair of mats, the mats each having at least one stack anchor, with the stack anchors of one pair of mats positionable directly above the stack anchors of the other pair of mats, and a connection bolt to secure an upper stack anchor with a lower stack anchor.

While the foregoing is directed to exemplary embodiments of the present invention, other and further embodiments of the invention may be devised without departing from the basic scope thereof, and the scope thereof is determined by the claims that follow.

I claim:

1. A pick mat connection system, comprising:

at least two mat anchors each connectable to a pick mat;

the mat anchors each having a pick point;

a lock shaped to engage the pick points of the mat anchors;

the mat anchors having a connected position and a disconnected position;

the mat anchors removably engaged with the lock in the connected position;

the mat anchors disengaged from the lock in the disconnected position;

a first pick mat connected to one of the mat anchors, and a second pick mat connected to the other mat anchor;

the pick point of the mat anchors removably engaged with the lock intermediate the pick mats in the connected position;

the mat anchors connected to their respective pick mat along an edge of their respective pick mat;

a first side-by-side pick mat assembly having the mat anchors in the connected position, with the respective pick mats oriented side-by-side;

each mat anchor having a flat mat surface, a pick point within a lock recess;

the lock recess having a cylindrical groove shape with an axis perpendicular to the mat anchor flat mat surface;

the pick point traversing the lock recess parallel to the mat anchor flat mat surface;

the lock having a cylindrical lock wall, corresponding in size to the lock recess, with a latch recess shaped to first linearly and then rotationally engage the pick point within the lock recess;

the first side-by-side pick mat assembly and a second side-by-side pick mat assembly each having a flat side spanning the pick mats;

the flat side of the first side-by-side pick mat on top of the flat side of the second side-by-side pick mat assembly;

the first side-by-side pick mat assembly having the pick mats running widthwise of the second side-by-side pick mat assembly;

each side-by-side pick mat assembly having a stacked mat anchor connected to one of the pick mats along a midline of the pick mat;

each stacked mat anchor having a stacked pick point;

a stacked lock lockably engageable with the stacked pick points of the stacked mat anchors;

the stacked mat anchors having a connected stacked position and a disconnected stacked position;

the stacked pick point of the stacked mat anchors removably engaged with the stacked lock intermediate the stacked pick mats in the connected stacked position; and the stacked pick point of the stacked mat anchors disengaged with the stacked lock in the disconnected stacked position.

2. The mat connection system of claim 1, further comprising:

the stacked lock having a bolt and two engagement ends; and at least one engagement end being adjustable in distance from the other engagement end.

3. The mat connection system of claim 2, further comprising:

one engagement end being a J-shaped ending formed in the bolt.

4. The mat connection system of claim 2, further comprising:

one engagement end being a hook slideable along a length of the bolt, and secureable to the bold by a nut.

5. A pick mat connection system, comprising:

a first pick mat assembly and a second pick mat assembly each having a flat side spanning the pick mat assembly;

the flat side of the first pick mat assembly on top of the flat side of the second pick mat assembly;

the first pick mat assembly having pick mats running widthwise of the second pick mat assembly;

each pick mat assembly having a stacked mat anchor connected to one of the pick mats along a midline of the pick mat;

each stacked mat anchor having a stacked pick point;

a stacked lock lockably engageable with the stacked pick points of the stacked mat anchors;

the stacked mat anchors having a connected stacked position and a disconnected stacked position;

the stacked pick point of the stacked mat anchors removably engaged with the stacked lock intermediate the stacked pick mats in the connected stacked position; and the stacked pick point of the stacked mat anchors disengaged with the stacked lock in the disconnected stacked position.

6. The mat connection system of claim 5, further comprising:

the stacked lock having a bolt and two engagement ends; and at least one engagement end being adjustable in distance from the other engagement end.

7. The mat connection system of claim 6, further comprising:

one engagement end being a J-shaped ending formed in the bolt.

8. The mat connection system of claim 7, further comprising:

one engagement end being a hook slideable along a length of the bolt, and secureable to the bold by a nut.

* * * * *